US005680780A

United States Patent [19]

Kim et al.

[11] Patent Number: 5,680,780

[45] Date of Patent: Oct. 28, 1997

[54] WASHING PULSATOR EQUIPPED WITH ROTATION CURRENT WASHING WINGS

[75] Inventors: Yong Sik Kim; Hack Jae Song, both of Kyungsangnam-Do, Rep. of Korea

[73] Assignee: LG Electronics Inc., Rep. of Korea

[21] Appl. No.: 582,704

[22] Filed: Jan. 4, 1996

[30] Foreign Application Priority Data

May 16, 1995 [KR] Rep. of Korea ..... 10344/1995

[51] Int. Cl.[6] ..... D06F 17/10

[52] U.S. Cl. ..... 68/134

[58] Field of Search ..... 68/134

[56] References Cited

U.S. PATENT DOCUMENTS 5,421,174 6/1995 Kim et al. ..... 68/134 X

FOREIGN PATENT DOCUMENTS 135095 8/1984 Japan ..... 68/134

261493 12/1985 Japan ..... 68/134

203897 8/1990 Japan ..... 68/134

*Primary Examiner*—Philip R. Coe

*Attorney, Agent, or Firm*—Ostrolenk, Faber, Gerb & Soffen, LLP

[57] ABSTRACT

A washing pulsator of a washing machine being provided with wings includes a cam assembly installed being movable up and down above an upper center portion; a plurality of current-forming ribs formed at an outer circumference of the cam assembly and being radially protruded toward the outer circumference from the center of an upper surface of the washing pulsator; a plurality of auxiliary rib, each of which is formed between the current-forming rib and radially protruded being shorter than the current-forming rib; and a rotating shaft installation aperture formed in front of the end tip of each of the auxiliary rib, the rotation current washing wings being installed to be capable of being inserted and detached in and from the rotating shaft installation aperture, thereby reducing textile entanglement and improving washing effect.

6 Claims, 9 Drawing Sheets

WASHING PULSATOR EQUIPPED WITH ROTATION CURRENT WASHING WINGS

BACKGROUND OF THE INVENTION

The present invention relates to a washing pulsator of a washing machine equipped with wings, and more particularly to a washing pulsator of a washing machine, being equipped with auxiliary ribs and a plurality of current-forming ribs each provided with a prong rib, and simultaneously, wings, thereby reducing entanglement of the laundry and improving washing function.

In a general washing machine as shown in FIG. 1, a driving unit 2 for driving the washing machine is provided at a lower portion of a washing machine body 1, and above the driving unit 2, an outer tub 4 is fixed to the body 1. Inside of the outer tub 4, an inner tub 5 is installed, which can be rotatable by means of the driving unit 2, and under the inner tub 5, a washing pulsator 6 is installed being rotatable by means of the driving unit 2.

A structure of the washing pulsator of the washing machine according to the conventional art will be described hereunder.

As shown in FIG. 2A a cam assembly 12 for circulating washing water up and down during washing operation is installed being movable up and down on the upper center of the washing pulsator 6.

At an outer circumference of the cam assembly 12, a plurality of streamline current-forming ribs 10 are projected and radially formed toward outer circumference. At the outer circumference of an upper surface of the cam assembly 12, a plurality of protrusions 13 of a predetermined shape are formed.

In the drawing, reference numeral 14 denotes protrusions formed on the upper surface of washing pulsator 6; reference numeral 15 denotes a draining hole; and reference numeral 16 denotes a screw which is used when the cam assembly 12 is assembled into the washing pulsator 6.

The washing operation of the conventional washing machine provided with washing pulsator 6 having such a shape will be described, hereunder.

When a washing operation starts after the laundry is put and washing water is filled in the inner tub 5 by a water-supplying valve (not shown), washing pulsator 6 which is installed at a lower portion of inner tub 5 rotates forward and reversely by means of the driving force of the driving unit 2 for rotating washing pulsator 6 forward and reversely, upon the control of a microcomputer 7 installed at the upper side of washing machine body 1, and clutch 3 for transmitting a rotating force of the driving unit 2. Thus, in the inside of inner tub 5, large washing current of a heart shape flows viewing from the front of inner tub 5, and cam assembly 12 moves up and down.

Here, the current-forming rib 10 forms the heart-shaped washing current and makes the flow of the laundry smooth.

However, the washing pulsator 6 of the conventional art has a problem of generating tangled textile in the laundry since the washing current flows only by up and down movements of the cam assembly 12 with respect to the heart-shaped current of inside of inner tub 5 produced by the forward and reverse rotation of washing pulsator 6. Also, it is a problem that a basic function of the washing machine renders inferior since washing deviation is generated due to the different shape between current-forming rib 10 and auxiliary rib 11.

SUMMARY OF THE INVENTION

To solve the above problems, it is an object of the present invention to provide a washing pulsator of a washing machine, being equipped with auxiliary ribs and a plurality of current-forming rib provided with a prong rib, and simultaneously, wings, thereby reducing entanglement of the laundry and improving washing function.

Accordingly, to achieve the above object, there is provided a washing pulsator of a washing machine being provided with wings which includes a cam assembly installed being movable up and down above an upper center portion; a plurality of current-forming ribs formed at an outer circumference of the cam assembly and being radially protruded toward the outer circumference from the center of an upper surface of the washing pulsator; a plurality of auxiliary rib, each of which is formed between the current-forming rib and radially protruded being shorter than the current-forming rib; and a rotating shaft installation aperture formed in front of the end tip of each of the auxiliary rib, the rotation current washing wings being installed to be capable of being inserted and detached in and from the rotating shaft installation aperture.

BRIEF DESCRIPTION OF THE DRAWINGS

The above objects and advantages of the present invention will become more apparent by describing in detail a preferred embodiment thereof with reference to the attached drawings, in which.

DETAILED DESCRIPTION OF THE INVENTION

The shape of a washing pulsator will be described, since the outside structure of a washing machine of the present invention is congruous with that of a conventional washing machine.

Figure 1:
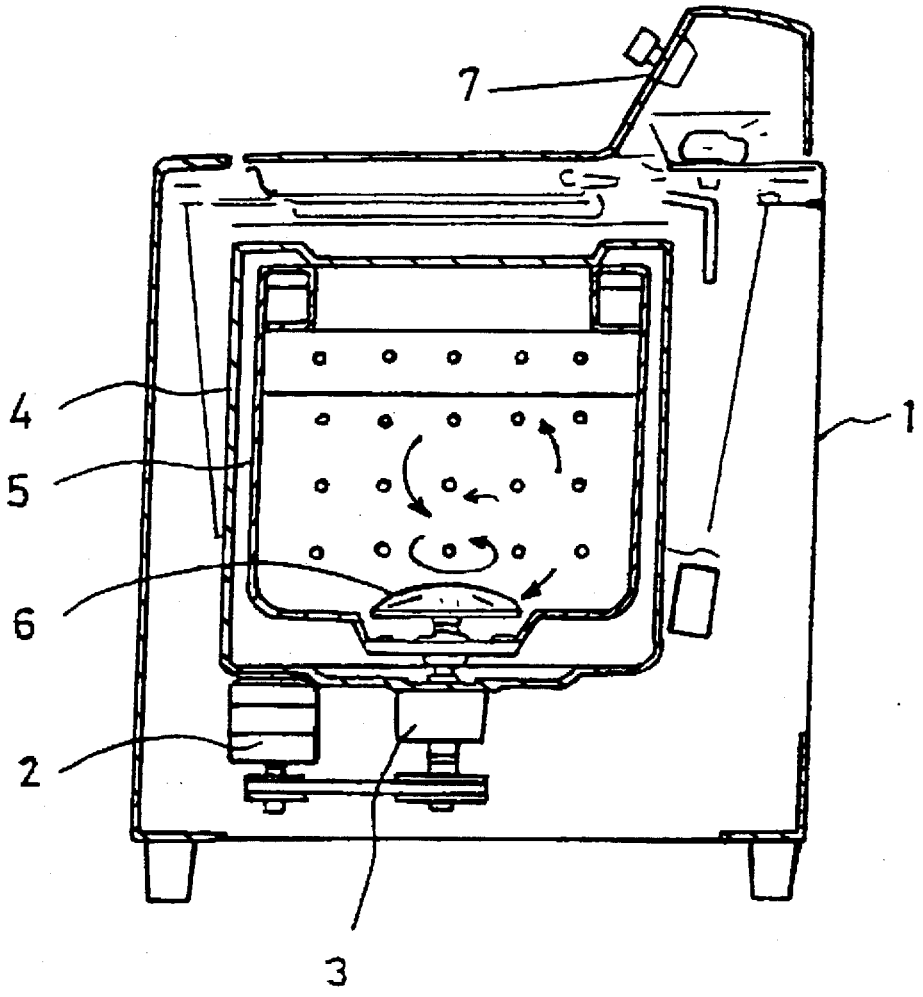
FIG. 1 CONVENTIONAL ART
FIG. 1 is a vertical sectional view illustrating an inside structure of a general washing machine.
Figure 2A:
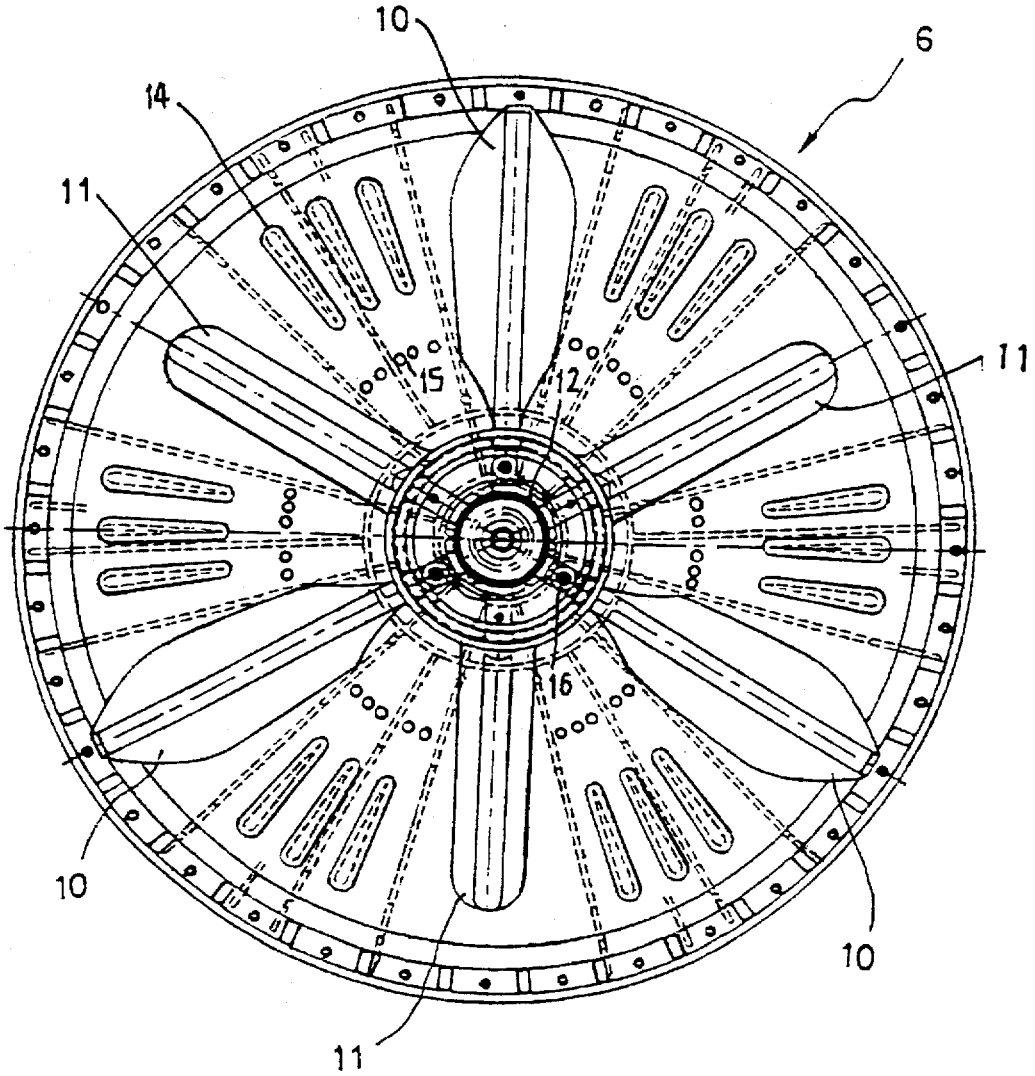
FIG. 2A CONVENTIONAL ART
FIG. 2A is a plane view illustrating a washing pulsator according to the conventional technology.
Figure 2B:
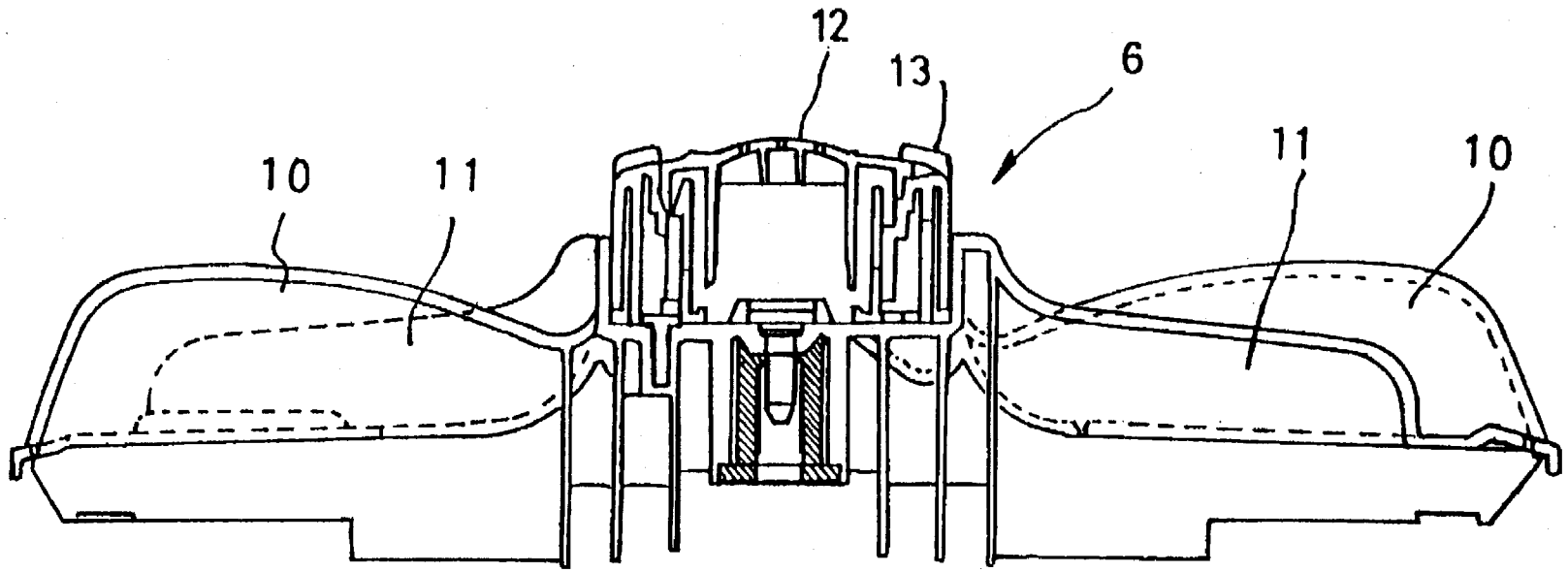
FIG. 2B CONVENTIONAL ART
FIG. 2B is a vertical sectional view illustrating the washing pulsator according to the conventional technology.
Figure 3A:
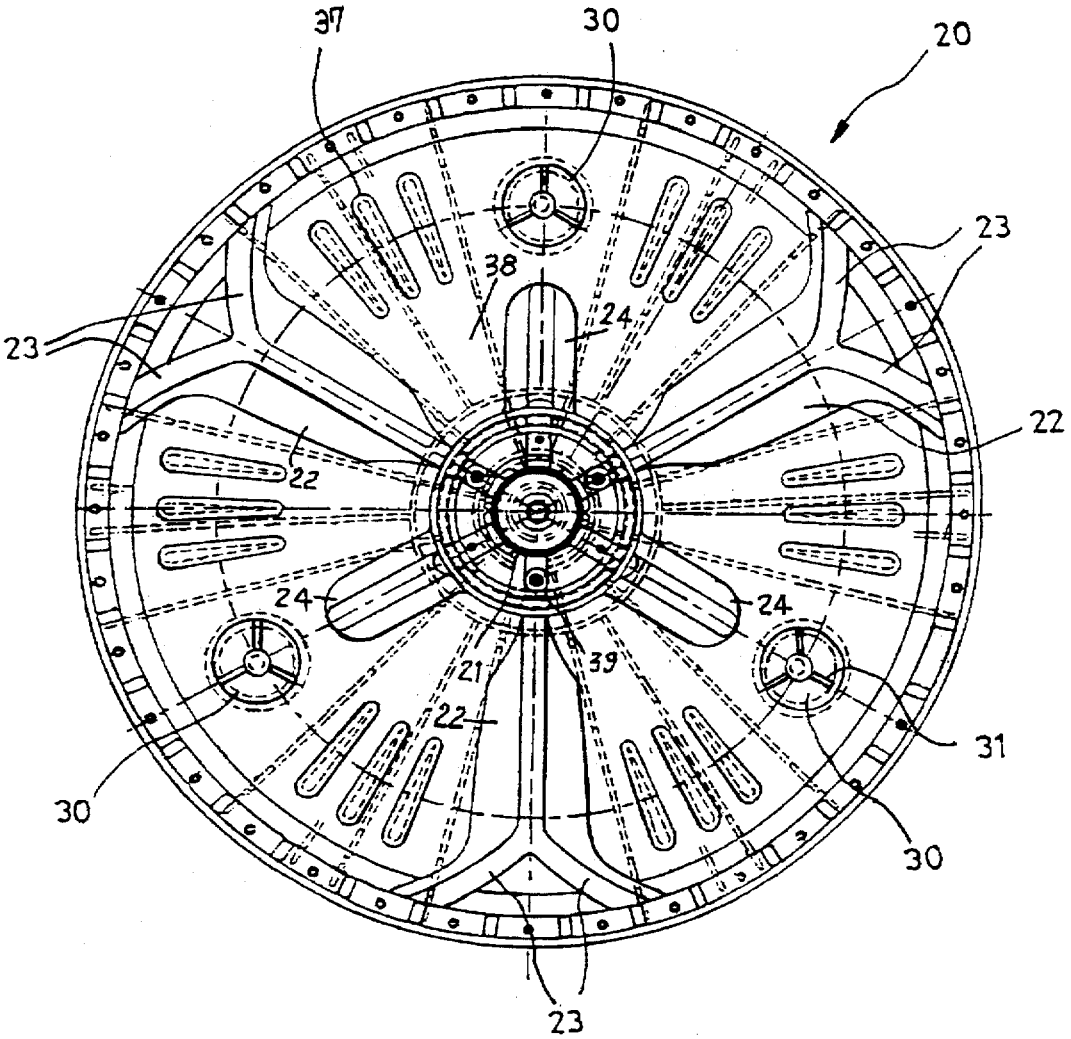
FIG. 3A is a plane view illustrating a washing pulsator according to the present invention.
Figure 3B:
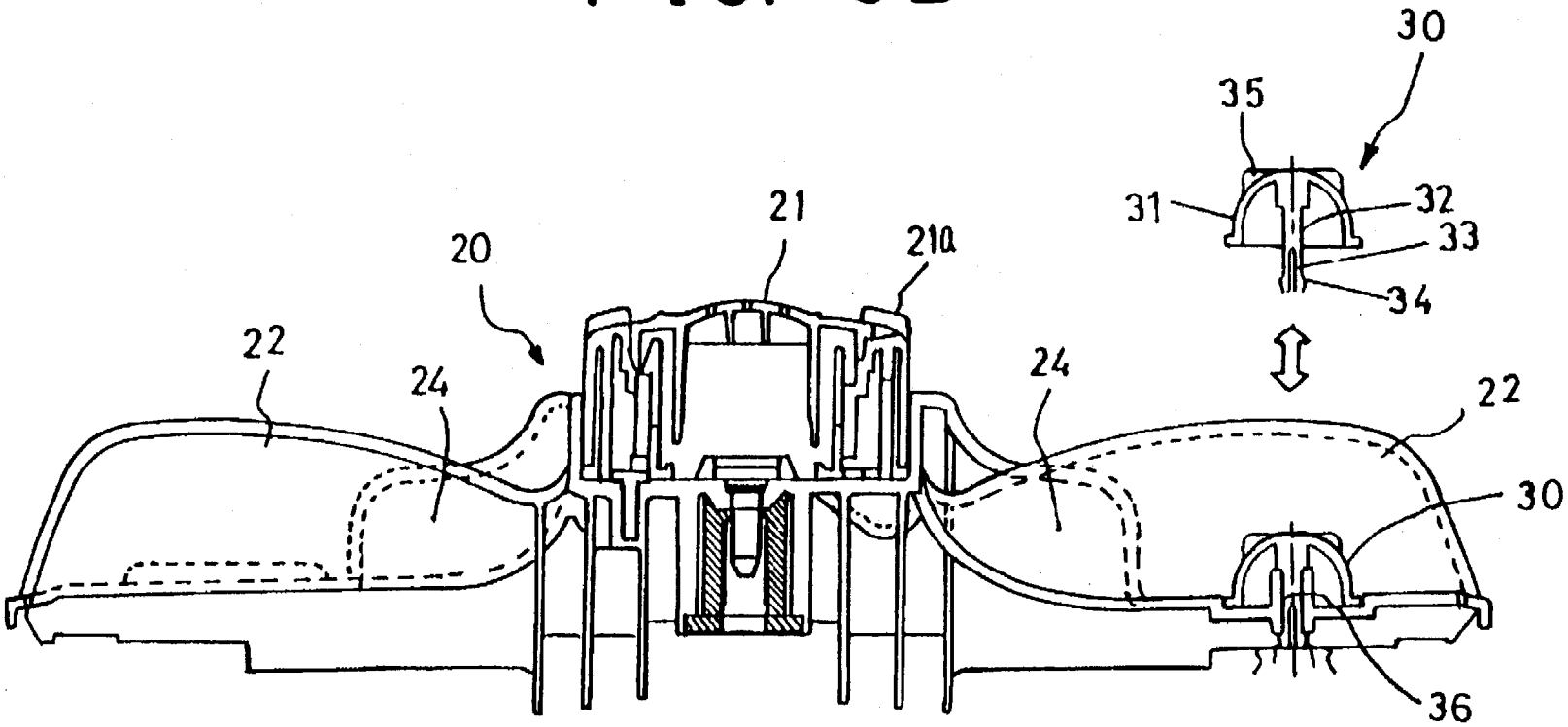
FIG. 3B is a vertical sectional view illustrating the washing pulsator according to the present invention.

As shown in FIGS. 3A and 3B, in a washing pulsator 20 of an embodiment of the present invention, a cam assembly 21 is installed being movable up and down at an upper center portion of the washing pulsator 20 to make washing-water flow up and down during a washing operation.

At an outer circumference of the cam assembly 21, a plurality of current-forming ribs 22 are protruded radially from the upper center portion of washing pulsator 20 toward the outer circumference portion. Each auxiliary rib 24 is radially protruded between the current-forming ribs 22, and at the outer circumference of the upper surface of cam assembly 21, a plurality of protrusions 21*a* of a predetermined shape are formed as shown in FIG. 3B.

Current-forming rib 22 is shaped streamlined at the center portion of washing pulsator 20 and two-forked at the outer circumference portion thereof, forming a prong rib 23 shaping into a caudal fin.

The length of auxiliary rib 24 is shorter than that of the current-forming rib 22, so that the rib does not reach the outer circumference of washing pulsator 20.

Meantime, in front of the outer end of auxiliary rib 24, a rotating shaft installation aperture 36 is provided on the upper surface of washing pulsator 20. Thus, a rotation current washing wing 30 is installed at each aperture 36 to be rotatable by friction of washing current without additional driving mechanism such as a gear.

The shape of the rotating current washing wing 30 and the principle of its coupling of washing pulsator 20 will be described in detail.

As shown in FIG. 3B, the rotating current washing wing 30 has an upper hemisphere-shaped body 31, and on the upper surface of body 31, a plurality of stumbling protrusions 35 are radially formed toward the peripheral portion from the center of body 31. Generally, three of stumbling protrusions 35 is formed at an angle of 120°.

At the lower center of body 31, a rotating shaft 32 is formed, and at the lower end of rotating shaft 32, a snapped portion 33 is formed being provided with a wedge type hook 34 at the end tip thereof.

Rotating shaft 32 having snapped portion 33 is detachably coupled to the rotating shaft installation aperture 36 which is formed on the upper surface of washing pulsator 20 by the hook 34 formed at the snapped portion 33.

Rotation current washing wing 30 can be detached from the rotating shaft installation aperture 36 of washing pulsator 20 by pressing hook 34 to press the lower portion of rotating shaft 32.

Figure 3C:
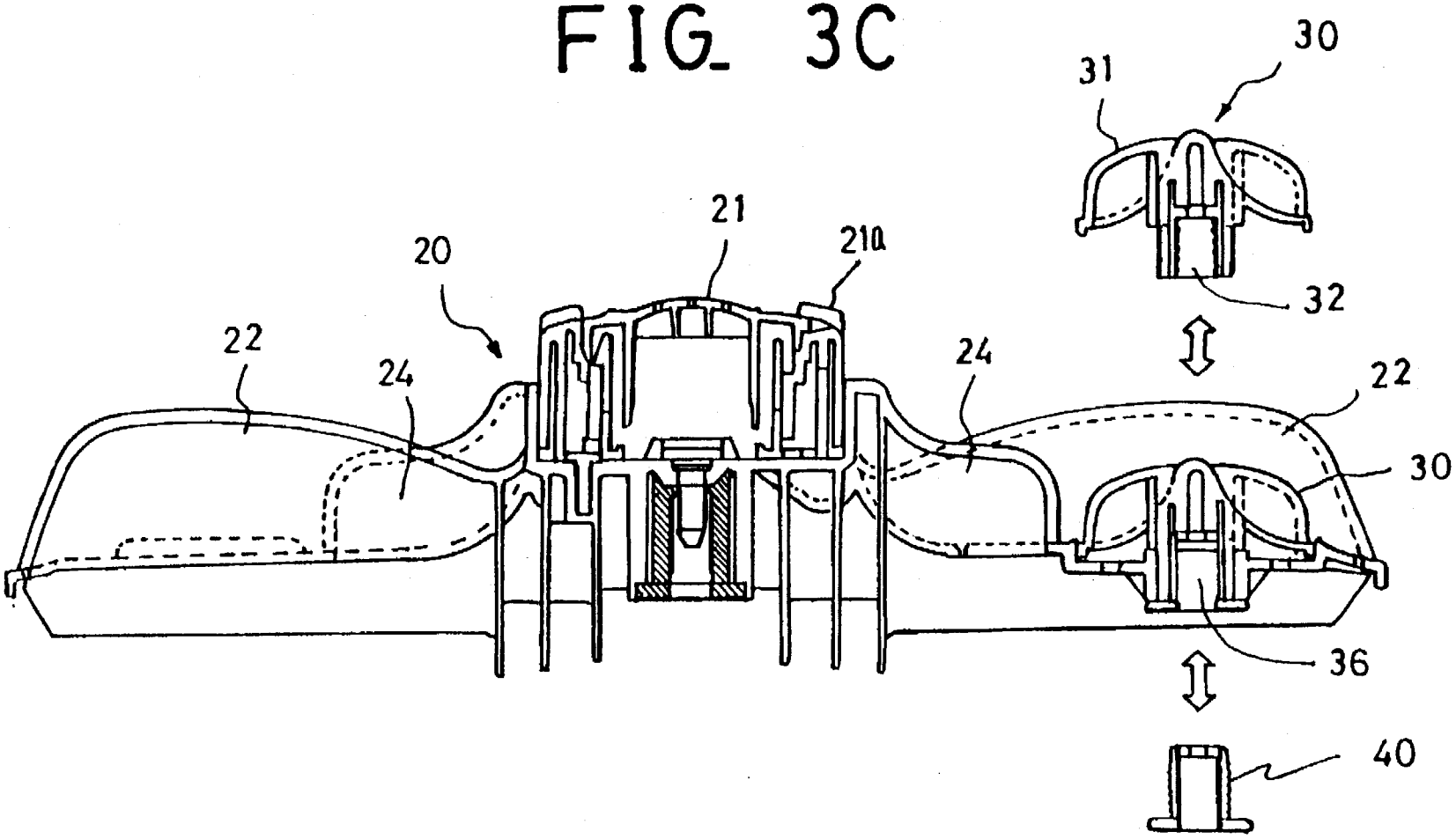
FIG. 3C is a vertical sectional view illustrating a washing pulsator according to another embodiment of the present invention.

In another embodiment of the present invention as shown in FIG. 3C, instead of forming the snapped portion 33 and wedge type hook 34 on the rotating shaft 32, a tooth-shaped portion is formed on the inner circumference surface of rotating shaft 32 to be inserted in the rotating shaft installation aperture 36. Then, by proving a busing 40 having the tooth-shaped portion on the outer circumference surface thereof, washing wing 30 can be inserted and detached in and from the rotating shaft 32 in a direction from the lower to upper portion of the rotating pulsator.

The operation of the washing pulsator in the washing machine according to the embodiment of the present invention will be described hereunder.

Figure 4A:
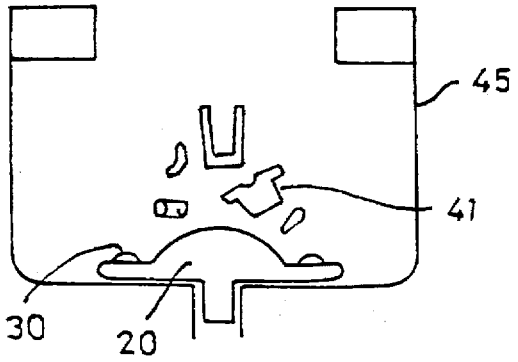
FIGS. 4A–4C are views showing a flow of washing by a washing machine provided with the washing pulsator according to the present invention.

As shown in FIG. 4A, when washing wing 20 rotates forward and reversely in the state that inner tub 45 of the washing machine is filled with the laundry and washing-water, a heart-type washing current formed by means of current-forming rib 22 and prong rib 23 is formed along with a multiple-step current continuously rising on the wall of inner tub 45, so that the formed current flow toward the center portion of washing pulsator 20 with washing-water.

Here, as the surface area of current-forming rib 22 becomes enlarged by means of prong rib 23 formed to be two-forked at the end tip of current-forming rib 22, the washing-water contacting area is amplified forming a strong rising current.

Figure 4B:
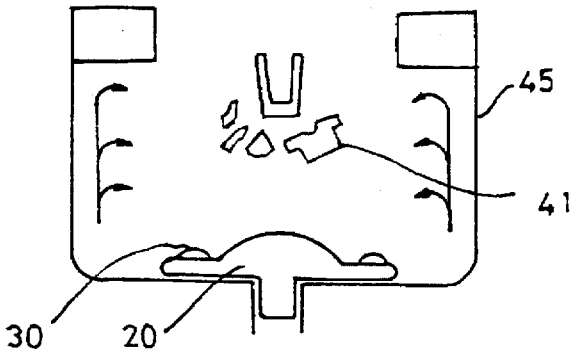

When the washing-water flows into the center portion of washing pulsator 20, multiple laundry in inner tub 45 get tangled. Here, as shown in FIG. 4B, the laundry moves up and down by the up and down movement of cam assembly 21 so that the entanglement of the laundry can be prevented.

Figure 4C:
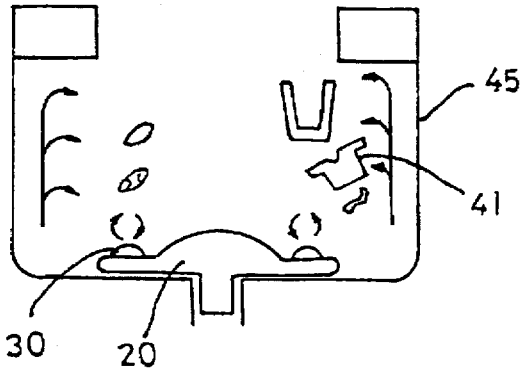
Figure 5A:
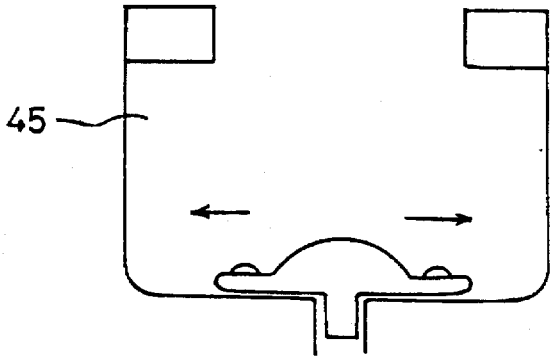
FIGS. 5A–5D are views showing a flow of current when washing is performed by the washing machine provided with the washing pulsator according to the present invention.
Figure 5B:
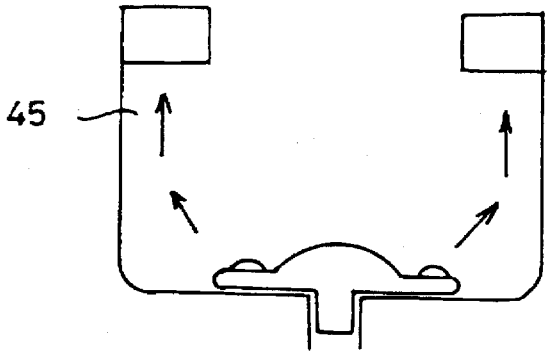
Figure 5C:
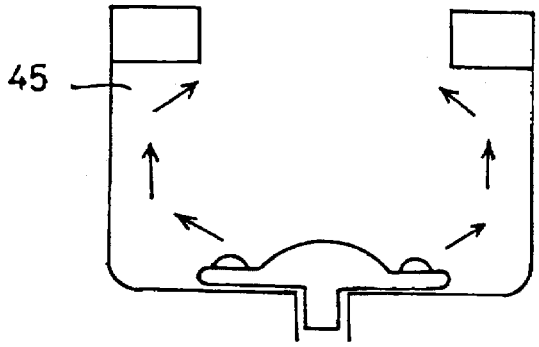
Figure 5D:
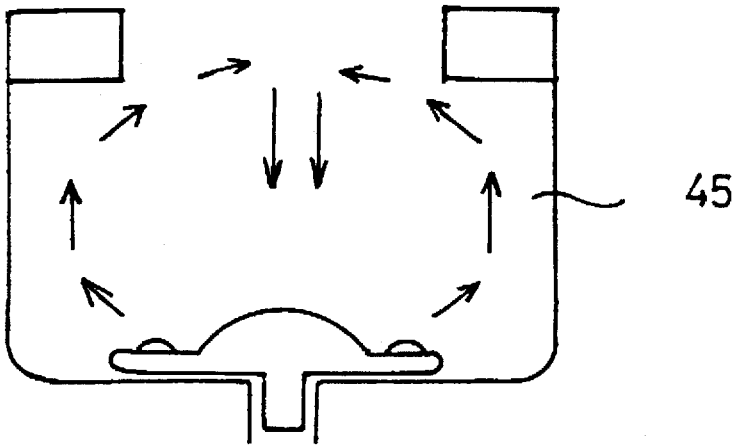

Continuously, the laundry floated upward in inner tub 45 moves to the upper side of the circumference of washing pulsator 20, as the heart-type current which is formed on the center portion of inner tub 45 by driving of prong rib 23 is being affected by the up and down movement of cam assembly 21. Concurrently, the laundry is precipitated by gravity toward a portion above rotation current washing wing 30 as shown in FIG. 4C.

When the laundry is moved above the rotation current washing wing 30, the laundry is stumbled due to friction with washing current at stumbling protrusion 35 formed on the upper surface of rotation current washing wing 30 which is rotating. Accordingly, the force applied to the laundry and the washing-water to move toward the center of inner tub 45 is reduced due to the rotation of wing 30.

That is, the laundry precipitated after generation of strong rising current is compensated by the rising current generated by rotation of wing 30, so that the entanglement of the laundry is prevented and washing performance is improved.

Of course, there may be an instant when the wet laundry of large amount presses rotation current former 30 due to the heavy weight of the wet laundry. Since the position of the laundry changes continuously according to the forward and reverse rotation of washing pulsator 20, the rotation of rotation current former 30 cannot be halted due to the weight of the laundry.

FIGS. 5A through 5D show a process of current when washing is performed in a washing machine having the washing pulsator according to the present invention.

As described above, the entanglement of the laundry can be reduced by the strong rising current formed by current-forming rib 22 and prong rib 23, the current generated by the cam assembly 21 and fluctuating up and down, and the rotation current formed by rotation current washing wing 30.

Also, every corner of the laundry can be washed by the rotation of rotation current washing wing 30, thereby reducing washing deviation rather than washing of a conventional washing machine.

In Table 1, the washing performance, textile entanglement, textile floating, temperature rising and washing deviation of the present invention are shown in comparison with the conventional art.

TABLE 1

| | CONVENTIONAL ART | PRESENT INVENTION |
|---|---|---|
| WASHING PERFORMANCE | 0.86 | 1.06 |
| TEXTILE ENTANGLEMENT | low water-level: 17%<br>mid water-level: 37%<br>high water-level: 39% | low water-level: 10%<br>mid water-level: 17%<br>high water-level: 25% |
| TEXTILE MOBILITY | 8 times | 9.76 times |
| TEMPERATURE RISING | 78.02° C. | 73.37° C. |
| WASHING DEVIATION | 1.4 | 0.9 |

In the drawings, reference numeral 37 denotes a protruding portion formed on the upper surface of washing pulsator 20; reference numeral 38 denotes a drain hole; reference numeral 39 denotes a screw which is used when the cam assembly is assembled into the washing pulsator.

As described above, the washing pulsator of the washing machine according to the present invention prevents textile entanglement since mobility of the laundry is increased by adding the rotation current by the rotation current washing wing and the current moving up and down by the up and down movement of the cam assembly to the strong heart type current formed by the current-forming rib and the prong rib on the washing pulsator. Particularly, the strong heart type current formed by the prong rib has an effect of promoting the washing performance.

Further, in the present invention, the conventional problem that washing deviation occurs due to the difference of shape of the current-forming rib and the auxiliary rib is compensated by the rotation current generated by the rotation of the rotation current washing wing, and cost can be reduced by installing the rotation current washing wing on the upper surface of washing pulsator being rotatable without additional driving mechanism such as a gear.

What is claimed is:

1. In a washing machine having a pulsator disposed for rotation within a central lower portion of an inner tub thereof, which pulsator includes a cam assembly disposed at a central portion of the pulsator, a plurality of current-forming ribs extending radially from the central portion of the pulsator, and a plurality of auxiliary ribs extending radially from the central portion of the pulsator and positioned intermediately between said current-forming ribs and being shorter than said current-forming ribs, the improvement comprising:

a rotating shaft installation aperture formed at a portion radially extending from an end tip of each of said auxiliary ribs; and a rotation current washing wing detachably inserted into said rotating shaft installation aperture.

2. The washing pulsator of claim 1, wherein each said current-forming rib is streamlined at those portions which are connected to said washing pulsator, and a prong rib having a two-forked shape is formed at radially extended end portions thereof.

3. The washing pulsator of claim 1, wherein said rotation current washing wing is installed to be rotatable under water pressure without any additional driving mechanisms.

4. The washing pulsator of claim 1, wherein said rotation current washing wing includes:

an upper hemispherically-shaped body;

a plurality of stumbling protrusions formed on an upper surface of said body and radially extending therefrom; and a rotating shaft extending to a lower side of said body, and having a snappable portion at a lower end thereof for being inserted into the rotating shaft installation aperture in the pulsator.

5. The washing pulsator of claim 4, wherein a wedge-type hook is formed at an end portion of said snappable portion.

6. The washing pulsator of claim 1, wherein said rotation current washing wing includes;

an upper hemispherically-shaped body;

a plurality of stumbling protrusions formed on an upper surface of said body and radially extending therefrom; and a rotating shaft extending from a lower side of said body, and having a protrusion on an inner surface thereof; and a brushing being inserted in the rotating shaft installation aperture formed in the pulsator and having a protrusion at an outer surface thereof to interlock with the protrusion of the rotating shaft.

* * * * *